US005406765A

United States Patent [19]

Brown

[11] Patent Number: 5,406,765

[45] Date of Patent: Apr. 18, 1995

[54] FIRE RESISTANT ROOF DECK STRUCTURE

[75] Inventor: Larry D. Brown, Newark, Ohio

[73] Assignee: Tectum, Inc., Newark, Ohio

[21] Appl. No.: 49,145

[22] Filed: Apr. 19, 1993

Related U.S. Application Data

[63] Continuation of Ser. No. 919,144, Jul. 23, 1992, abandoned, which is a continuation of Ser. No. 507,168, Apr. 10, 1990, abandoned.

[51] Int. Cl.[6] ..... E04B 5/00

[52] U.S. Cl. ..... 52/409; 52/410

[58] Field of Search ..... 52/408, 410, 411, 412, 52/338, 339, 438, 324, 333–335, 340, 337, 778, 779, 586

[56] References Cited

U.S. PATENT DOCUMENTS 4,832,816 9/1971 Jahn ..... 52/779

*Primary Examiner*—Carl D. Friedman
*Assistant Examiner*—Creighton Smith
*Attorney, Agent, or Firm*—Fay, Sharpe, Beall, Fagan, Minnich & McKee

[57] ABSTRACT

A building roof deck structure having significant fire resistance comprises a plurality of wood cement or fiber cement panels lying in a common plane and having abutting edges with aligned grooves extending along the abutting edges inwardly of the panels. Structural steel, T-shaped members are positioned between the butting edges with the flanges of the T-shaped members extending into and closely enclosed by the aligned grooves. The webs of the T-shaped members are positioned to extend in a direction outwardly of the building. A fire resistant grout is placed between the abutting edges to totally enclose the webs of the T-shaped members; and, urethane foam insulating panels overlie the wood cement panels and a waterproof roofing layer extends over said urethane foam panels.

1 Claim, 2 Drawing Sheets

FIRE RESISTANT ROOF DECK STRUCTURE

This application is a continuation application of U.S. Ser. No. 07/919,144, filed Jul. 23, 1992, now abandoned, which is a continuation application of U.S. Ser. No. 07/507,168, filed on Apr. 10, 1990, now abandoned.

BACKGROUND OF THE INVENTION

The subject invention is directed toward the building construction art and, more particularly, to an improved roof deck structure having significant fire resistant properties. More particularly, the invention provides a roof deck structure which is formed as a multiple layer composite from commercially available material to produce a structure which has significant resistant to damage from fire and which is capable of withstanding high temperatures for a relatively extended period of time.

Many different types of roof deck structures have been proposed in the prior art. Significant efforts have been expended in providing roof deck structures formed from various panel arrangements using both synthetic resinous foams, gypsum board and cementatious board materials. Typically, however, these prior art structures have been expensive and/or difficult to form. In addition, their fire resistant properties have been less than desirable. Often, the various support beams and the like have not been fully and properly protected from the surrounding environment. Accordingly, there has been a distinct need for a structure which overcomes the above and other disadvantages present in the prior art.

SUMMARY OF THE INVENTION

In accordance with the subject invention, there is provided a roof deck structure which has significant fire resistant properties and comprises a plurality of wood-cement or fiber-cement main panels laying in a common plane with their edges in abutting relationship. Aligned grooves and recesses are formed along the abutting edges inwardly of the main panels. Structural steel members having laterally extending flanges are positioned between the abutting edges with the flanges of the members extending into and closely enclosed by the aligned grooves of the panels. The structural steel members have web portions positioned to extend in a direction outwardly of the building between the abutting edges of the main panels. A fire resistant grout is inserted between the abutting edges in an arrangement to totally enclose the webs of the structural steel members. In addition, insulating foam panels overlay the main panels on the exterior side thereof and a multiply layer of roofing material is sealingly enclosed over the exterior side of the foam panels.

In accordance with a more specific aspect of the invention, the foam panels are an expended urethane which is bonded to the exterior surface of the main panels throughout the extent of their engagement. Additionally, it is preferred that the structural steel members be T-shaped and be fully enclosed by the main panels and the fire resistant grout.

In accordance with a still further object of the invention, continuous sections of foam insulation are preferably located over the webs of the structural steel members at a location between the abutting edges of the wood-cement panels. This provides further insulation and protection for the structural steel support members.

In accordance with yet another aspect of the invention, the main roof deck panels and the structural members are supported by transversely extending main steel beam members which are enclosed by a housing formed from fiber-cement panel members which are joined to the underside of the main roof deck panel members.

As can be seen from the foregoing, a primary object of the invention is to provide a simplified and highly efficient fire resistant roof deck structure.

A still further object of the invention is the provision of a roof deck structure of the type described wherein the steel support beams and related steel support elements are totally enclosed by the fire resistant fiber-cement panels and grout material.

Yet another object of the invention is the provision of a roof deck structure which can be readily formed from commercially available materials.

A still further object is the provision of a structure of the type described which is extremely simple to construct and maintain.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
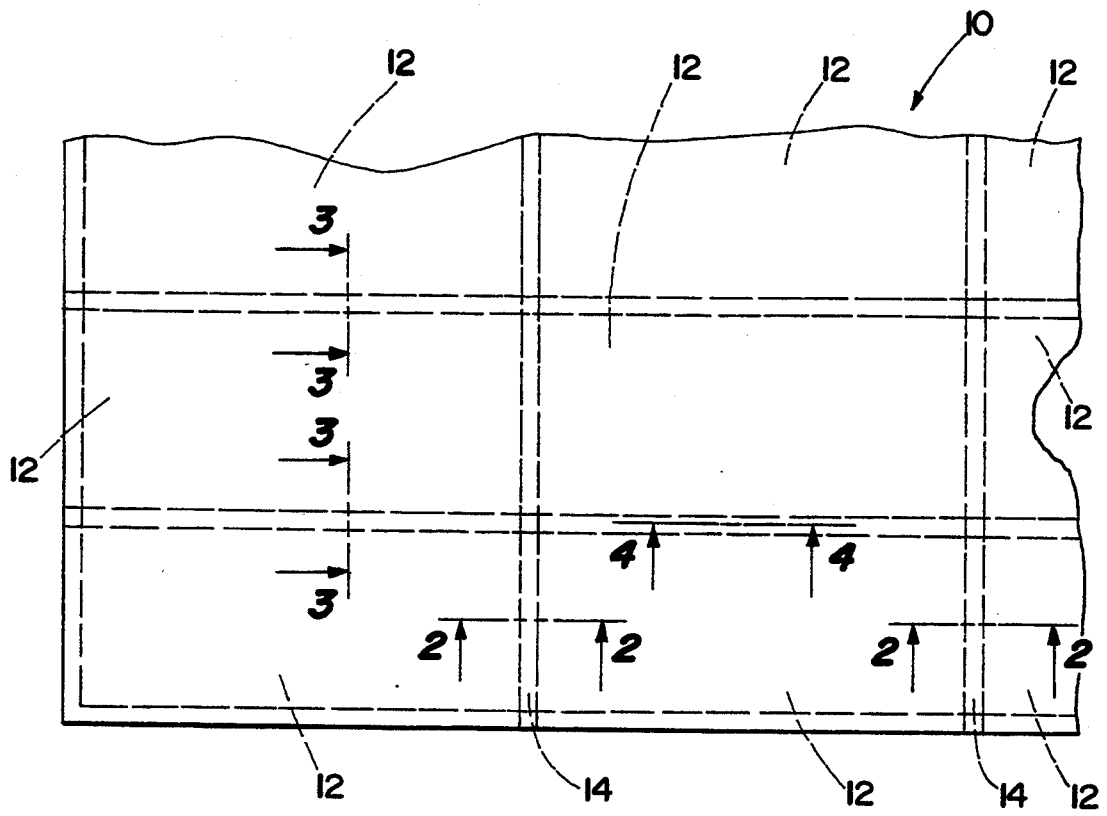
FIG. 1 is a plan view, somewhat diagramic, of a roof deck structure formed in accordance with the subject invention.

Referring more particularly to the drawings wherein the showings are for the purpose of illustrating a preferred embodiment of the invention only, and not for the purpose of limiting the same, FIG. 1 is a plan view illustrating a fire resistant roof deck arrangement 10 which is formed from a plurality of discrete abutting and interconnected main panel sections 12 which are supported from main beams 14 which are suitably carried on vertical columns or walls not illustrated and which support transversely extending steel support members 16. Members 16 are carried within and form an integral part of the roof deck structure as will subsequently become apparent.

The panels 12 can have a variety of different sizes and overall configurations. However, according to the subject preferred embodiment, the individual panel sections are in the range of approximately three feet by eight feet and are formed from a fiber-cement or wood-cement material such as those sold under the tradename "TECTUM". These particular panels are approximately three inches in thickness and are comprised of a mixture of excelsior and one or more inorganic cements. The resulting panels have significant strength and fire resistance.

Figure 2:
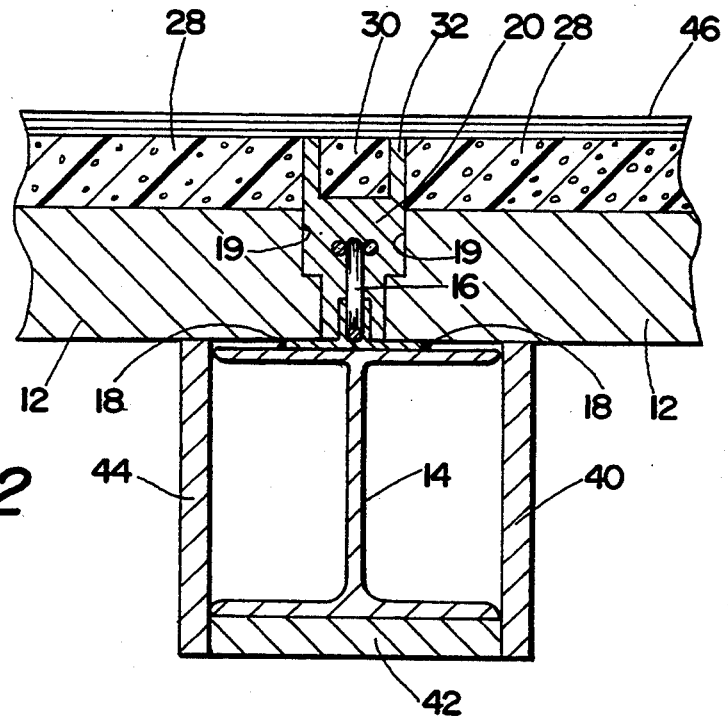
FIG. 2 is a cross-sectional view taken at lines 2—2 of FIG. 1 and showing the manner in which the structural steel T-shaped support members are supported from the main beams and encased in the roof deck panel structure.
Figure 3:
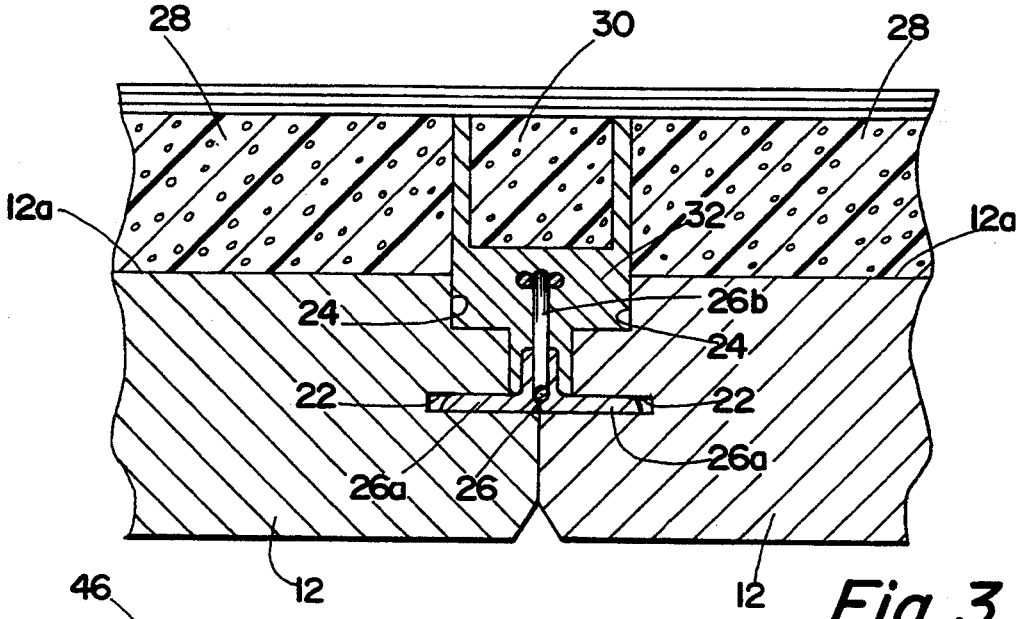
FIG. 3 is a cross-sectional view taken on line 3—3 and showing the adjoining lateral edges of the main roof defining panel structures and their associated support steel T-shaped structural members.
Figure 4:
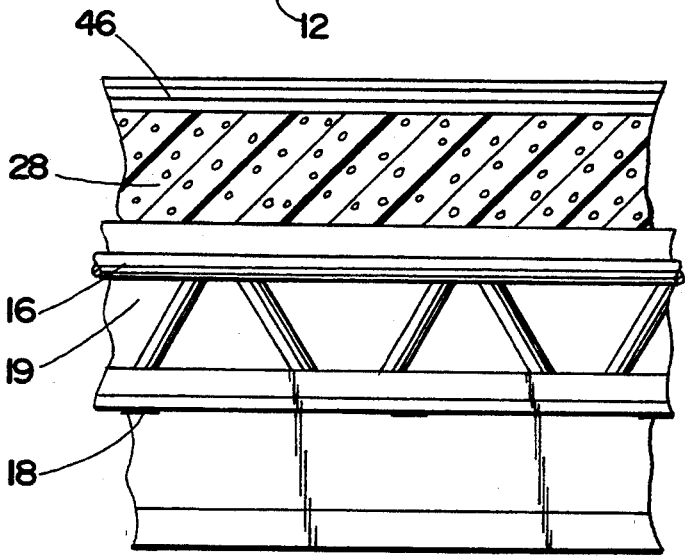
FIG. 4 is a cross-sectional view taken on line 4—4 of FIG. 1 presenting an elevational view of the longitudinally extending support members.
Figure 5:
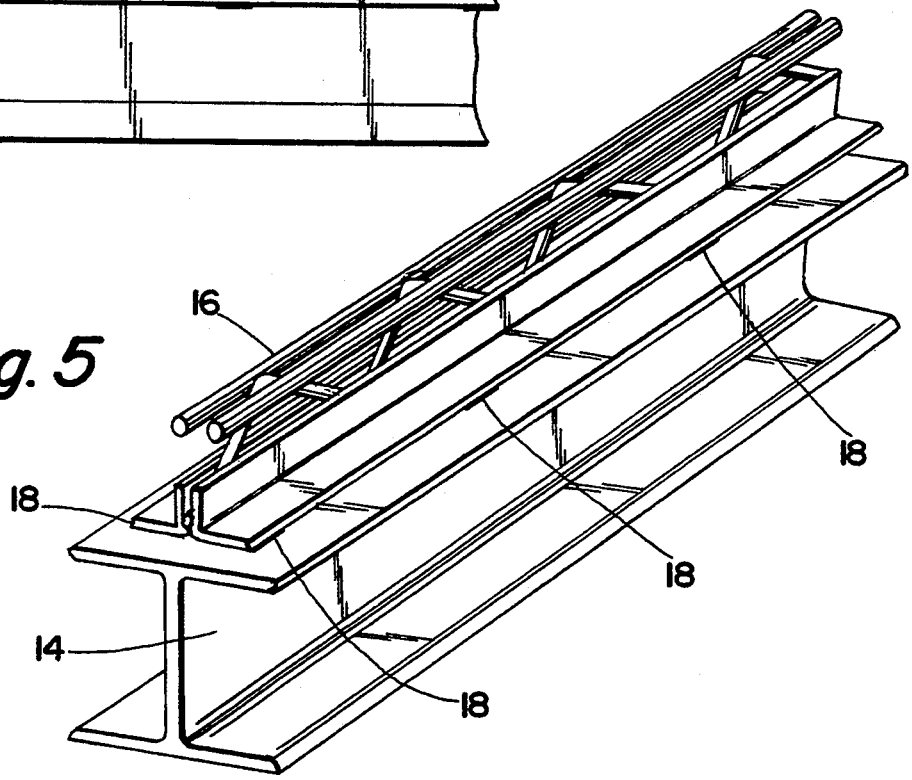
FIG. 5 is a pictorial view showing the main structural steel members and their method of interconnection as depicted in FIG. 2.

Referring to FIGS. 2 and 3, it will be seen that the individual main panels 12 are supported from a spaced series of parallel positioned structural members 14 which, in the subject embodiment, are steel H-beams. It should, of course, be understood that other types of main beams could be used. Joined to the top of each of the beams 14 (as best seen in FIGS. 2 and 5) are relatively conventional T-shaped truss elements 16 of a well-known design. In particular, the flanges of the truss-T's are formed by angle iron members and the webs are defined by rods formed and joined as shown by welding truss-T elements 16 are joined to extend longitudinally of the main structural beams 14 by suitable welds 18 positioned therealong. This maintains the structural T truss elements 16 in rigidly connected aligned relationship with the beam 14. Specifically, in the embodiment shown, three-quarter inch fillet welds are provided at each end of the truss-T and welds are made at alternate sides along the length at suitable spacings.

As can be seen in FIG. 2, the end of the main fiber-cement panels 12 are carried on the truss-T's 16 and spaced a short distance therefrom. The ends are rabbeted as shown at 19 to provide an upwardly open channel or groove 20.

Along the lateral side edges of the main fiber-cement panels 12 (see FIG. 3) there are provided longitudinally extending grooves 22 and suitable recessed or rabbeted areas 24. A suitable truss-T element 26 having the general shape and construction as previously described with reference to truss-T 16 is received in the grooves 22 and recesses 24 as shown is a truss-T 26. Specifically, truss-T 26 is positioned with its flange portions **26*a* closely received in the grooves 22. Its web section 26*b* is positioned to extend outwardly of the building toward the exterior thereof and into the somewhat larger channel defined by the recesses 24. In this manner, truss-T 26** provides structural support for the lateral side edges of the fiber-cement panels. It is, however, totally enclosed within the fiber-cement panels and is thus given significant protection from fire.

As best seen in FIGS. 2 and 3, a layer of relatively rigid insulating foam is bonded to the upper or outer surface **12*a* of each of the panels 12. In the subject embodiment, the foam panels 28 are preferably approximately two inches thick and are suitably bonded to the panels 12 with any desired type of suitable adhesive. Although many types of insulating foam could be used, the subject invention uses a relatively rigid urethane foam of a size generally corresponding to the size of the main fiber-cement panels. Thus, preferably, the sides and ends of the panels 28 terminate at locations generally corresponding to the side edges and end edges of the associated fiber cement panels. Consequently, an upwardly open recess or groove results between the adjacent panel sections. Preferably, an elongated rectangular section of expanded urethane foam block 30 is positioned in the open upper end of this recess and the available space about the foam block 30 is filled with a suitable fire resistant grout 32** as shown. Many different types of grout could be used in the practice of the invention; however, a preferred type is a grout sold under the tradename TECTUM grout and comprising a mixture of gypsum and perlite. Other grouts which could be used include portland cement and other gypsum based mixtures.

Application of the grout 32 is carried out in a manner to totally fill the available material about the truss-T's 26 and the foam blocks 30. The individual support channels or truss-T's 26 are thus totally enclosed and protected by the panels 12, 28 and the grout material 32.

To further isolate the structural steel members from the surrounding environment and to protect them in case of fire, the lower main structural members 14 are encased in a box housing comprised of cement fiber boards 40, 42 and 44 which enclose the associated beam 14 and are joined to the underside of the cement fiber panels 12 as shown in FIG. 2. Any suitable method of joining the boards 40, 42 and 44 can be used, including suitable mechanical fasteners such as screws, nails or the like.

The entire outer surface of the deck structure thus far described is covered with a roofing membrane which could be of many different types. In the subject embodiment, the roofing membrane 46 is a conventional three-ply built-up roof applied to provide a water-tight seal. The peripheral edges of the entire deck structure can be supported in any suitable manner but, preferably, the supports are any desired type of structural channel, truss, or the like embedded into suitable recesses in the outer peripheral edges and bonded or joined therein through the use of a fire resistant grout as previously described.

The invention has been described in great detail sufficient to enable one of ordinary skill in the art to make and use the same. Obviously, modifications and alternations of preferred embodiment will occur to others upon the reading and understanding of the subjects specifications and it is our intention to include all such modifications and alterations as part of our invention insofar as they come within the scope of the appended claims.

What is claimed is:

1. A building roof deck structure having significant fire resistance and comprising:

a plurality of wood cement panels lying in a common plane and having abutting side edges and end edges with aligned grooves extending along said abutting side and end edges inwardly of said panels;

a first plurality of structural steel T-shaped members each having a web with flanges extending laterally therefrom, the first plurality of T-shaped members positioned between said abutting side edges with the flanges extending into and closely and fully enclosed by said aligned grooves and the webs extending in a direction outwardly of the building;

a second plurality of structural steel, T-shaped members each having a web with flanges extending laterally therefrom, the second plurality of T-shaped members extending transversely to said first plurality with the web portions of the second plurality extending into and closely and fully enclosed by said aligned grooves between said end edges;

a fire resistant grout between said abutting edges and enclosing the webs of said T-shaped members of both the first and second plurality;

insulating urethane foam panels overlying and bonded to said wood cement panels and a multi-ply layer waterproof roofing layer over said urethane foam panels; and, the deck structure being supported by steel beams positioned under said deck structure and enclosed in a box housing of cement fiber boards.

* * * * *